US006036474A

United States Patent [19]

Diep et al.

[11] Patent Number: 6,036,474

[45] Date of Patent: Mar. 14, 2000

[54] GAS BURNER FOR FIREPLACE

[75] Inventors: Dung Diep, Toronto; Duong Luu; Syd Barkhouse, both of Mississauga, all of Canada; Patrick Kelly, Fort Wayne; Thomas John Beal, Ossian, both of Ind.

[73] Assignee: CFM Majestic, Inc., Mississauga, Canada

[21] Appl. No.: 09/208,351

[22] Filed: Dec. 9, 1998

[30] Foreign Application Priority Data

Dec. 24, 1997 [CA] Canada ..... 2225992

[51] Int. Cl.[7] ..... F23Q 2/32; F24C 3/04; F24C 3/00

[52] U.S. Cl. ..... 431/125; 431/126; 126/92 R; 126/92 AC; 126/91 R; 126/512

[58] Field of Search ..... 431/125, 126; 126/92 R, 92 AC, 91 R, 512

[56] References Cited

U.S. PATENT DOCUMENTS

| | | | |
|---|---|---|---|
| 1,286,108 | 11/1918 | Richards | 431/125 |
| 4,602,609 | 7/1986 | Wright | 431/125 |
| 4,838,240 | 6/1989 | Rieger | 126/512 |
| 4,869,664 | 9/1989 | Wright et al. | 431/125 |
| 5,313,932 | 5/1994 | Rieger et al. | 126/531 |
| 5,328,356 | 7/1994 | Hawkinson | 431/125 |
| 5,399,084 | 3/1995 | McCullough et al. | 431/125 |
| 5,645,409 | 7/1997 | Ni et al. | 431/125 |
| 5,660,162 | 8/1997 | Eavenson et al. | 431/125 |
| 5,890,485 | 4/1999 | Shimek et al. | 431/125 |

*Primary Examiner*—Ira S. Lazarus
*Assistant Examiner*—David Lee
*Attorney, Agent, or Firm*—Baker & Daniels

[57] ABSTRACT

A gas burner for a fireplace. The burner comprises a burner housing having a grid of openings that are formed from heat resistant material. The housing has a first burner assembly and a second burner assembly arranged therein in a side-by-side relationship, each burner assembly having a chamber with a perforated gas distribution plate. The gas distribution plate is located adjacent the grid. Each of the burner assemblies has a gas mixing area with an inlet for primary air and combustible gas, and air flow controllers e.g. primary air shutters, for controlling the ratio of primary air to gas in the first burner assembly lower than the ratio in the second burner assembly.

11 Claims, 6 Drawing Sheets

GAS BURNER FOR FIREPLACE

FIELD OF THE INVENTION

The present invention relates to fireplaces, and in particular to a gas burner for a fireplace that provides variations in the height and appearance of the flame in the fireplace. In particular, the gas burner provides combustible gas mixed with so-called primary air in two different ratios of air:gas in order to provide the variations in the flame in the fireplace.

BACKGROUND OF THE INVENTION

Fireplaces with a prefabricated combustion chamber for combustion of natural, propane or other such gases are known. These fireplaces may be either inserted into existing conventional masonry fireplaces or may be installed and subsequently framed within the structure of the building, with the combustion chamber vented into a flue or chimney. A facade is installed so that the exterior has visual appeal. The heating and visual effects of the fireplace per se are provided by means of a gas burner which simulates a conventional wood fire, with the combustion conditions being carefully controlled.

In fireplaces in which combustion products from the burner are conveyed to the flue, a supply of air may be provided to the flue to ensure that there is a constant flow of combustion products from the combustion chamber into the flue and also to dilute the combustion products to reduce condensation in the flue. Air may also flow into the combustion chamber. Fireplaces for the burning of combustible gases, with combustion products being conveyed from the burner to the flue, are described in U.S. Pat. No. 5,313,932 of H. H. Rieger and C. Adamson.

Other types of fireplaces are known as vent-free appliances, in which case the fireplace is operated without the need to vent combustion gases.

In the combustion chamber of the fireplace, it is common to simulate a wood fire by placing logs made from a ceramic material above the gas burner. The logs are normally painted to resemble a log, and are arranged to simulate logs on a wood fire. The logs are located on a ceramic grid through which combustible gas admixed with air passes and is ignited. The resultant flame tends to heat the ceramic log material to a red glow, thereby causing the visual effect of a wood fire. Fireplaces typically use a flame that is relatively static throughout its length and does not vary significantly with time.

In the present application, the flames of the fireplace may be described as a blue flame or a yellow flame, which describes the visual nature of the flame.

SUMMARY OF THE INVENTION

A burner assembly has now been found that is capable of providing both a blue flame for creating sufficient heat to cause the ceramic grid, ceramic logs and media to glow red, as well as a yellow flame that varies with time. Media are small ceramic fragments which glow red and give the appearance of embers in the fire.

Accordingly, an aspect of the present invention provides a gas burner for a fireplace, comprising:

a burner housing having a grid of openings in a surface thereof, said grid being formed from heat resistant material, said housing having a first burner assembly and a second burner assembly arranged therein in a side-by-side relationship, each burner assembly having a chamber with a perforated gas distribution plate forming a surface thereof, said gas distribution plate being located adjacent said grid, each of the burner assemblies having a gas mixing area with an inlet for air and combustible gas, and air flow controllers for controlling the ratio of said air to gas in the first burner assembly lower than the ratio in the second burner assembly.

In a preferred embodiment of the gas burner of the present invention, the air flow controller is in the form of an adjustable opening for inlet of air, especially in the form of an adjustable shutter, and said air is primary air for the gas burner.

In another embodiment, the second burner assembly provides a greater amount of primary air for combustion of said gases at said orifices than said first burner assembly.

In a further embodiment, the first burner assembly provides a yellow flame and the second burner assembly provides a blue flame.

In yet another embodiment, the air flow controller of the first burner assembly controls the ratio of primary air and gas such that secondary air from exterior to said burner assembly is required for complete combustion of the gas, the resultant flame being a yellow flame.

In a still further embodiment, the grid is formed of ceramic.

In yet another embodiment, the perforations in the distribution plate are larger for the second burner assembly.

BRIEF DESCRIPTION OF THE DRAWINGS

The present invention is illustrated by the embodiments shown in the drawings, in which.

DETAILED DESCRIPTION OF THE INVENTION

Figure 1A:
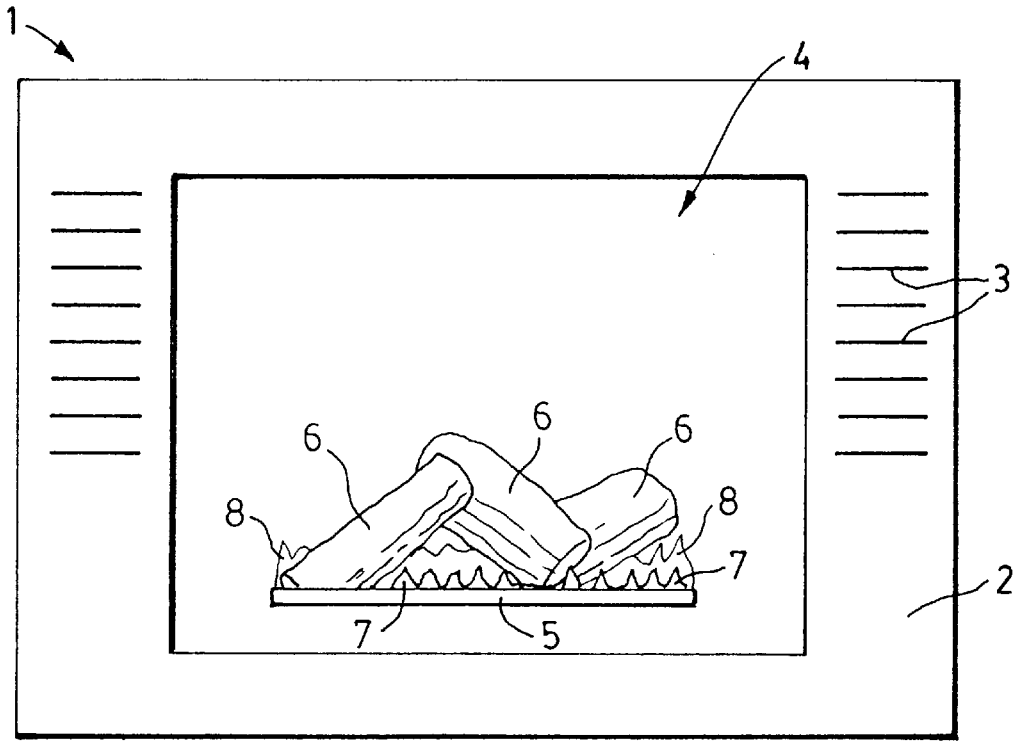
FIG. 1A PRIOR ART
FIG. 1A is a schematic representation of a fireplace of the prior art.

Referring to FIG. 1A, which illustrates prior art, fireplace 1 has a facade 2 with air vents 3. Facade 2 surrounds glass panels or doors on the front of combustion chamber 4. Combustion chamber 4 contains ceramic grid 5 with logs 6 thereon, logs 6 being formed of a ceramic material, and normally painted to resemble the visual appearance of a wooden log. A blue flame 7 is shown as extending a short distance above the ceramic grid 5, with a yellow flame 8 extending above the level of blue flame 7. In the representation of the prior art, the yellow flame is of a substantially even height across the width of the ceramic grid, and exhibits only a minor amount of variation with time.

Figure 1B:
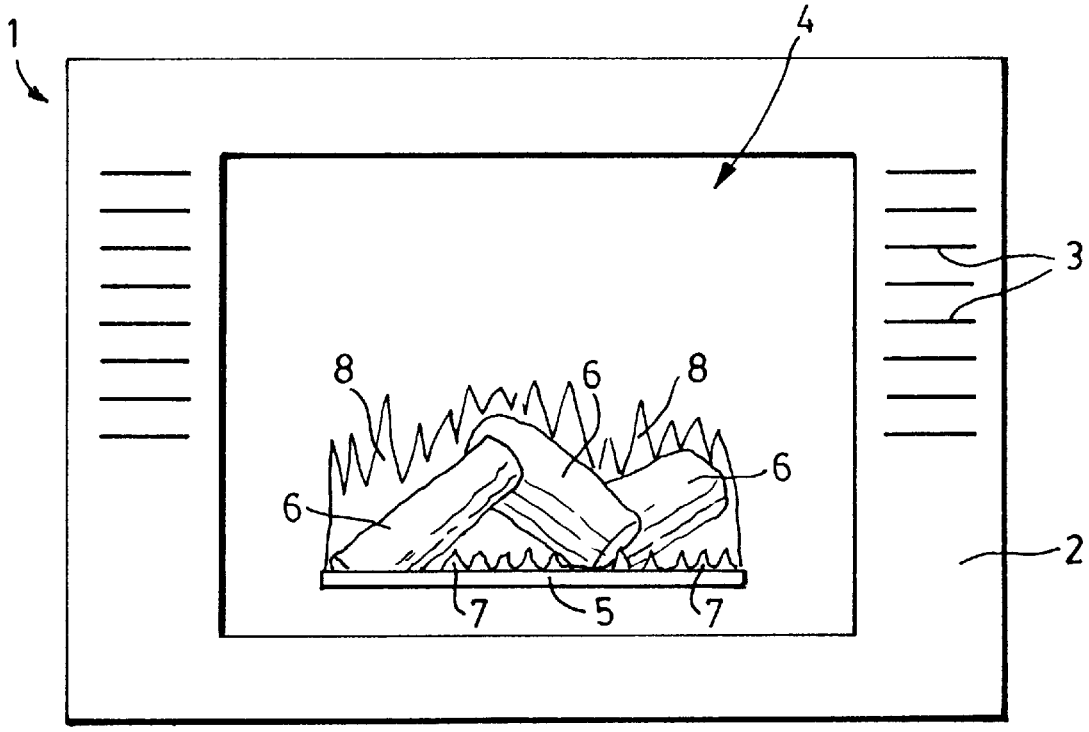
FIG. 1B is a schematic representation of a fireplace of the present invention.

In FIG. 1B, fireplace 1 is the same as shown in FIG. 1A, with blue flame 7 extending for a short distance above ceramic grid 5. However, in the embodiment of the invention illustrated in FIG. 1B, yellow flame 8 extends substantially above blue flame 7, and furthermore is not substantially of the same height across the width. In addition, as discussed below, the height of the yellow flame varies in a random pattern, and more closely simulates a natural wood fire.

Figure 2:
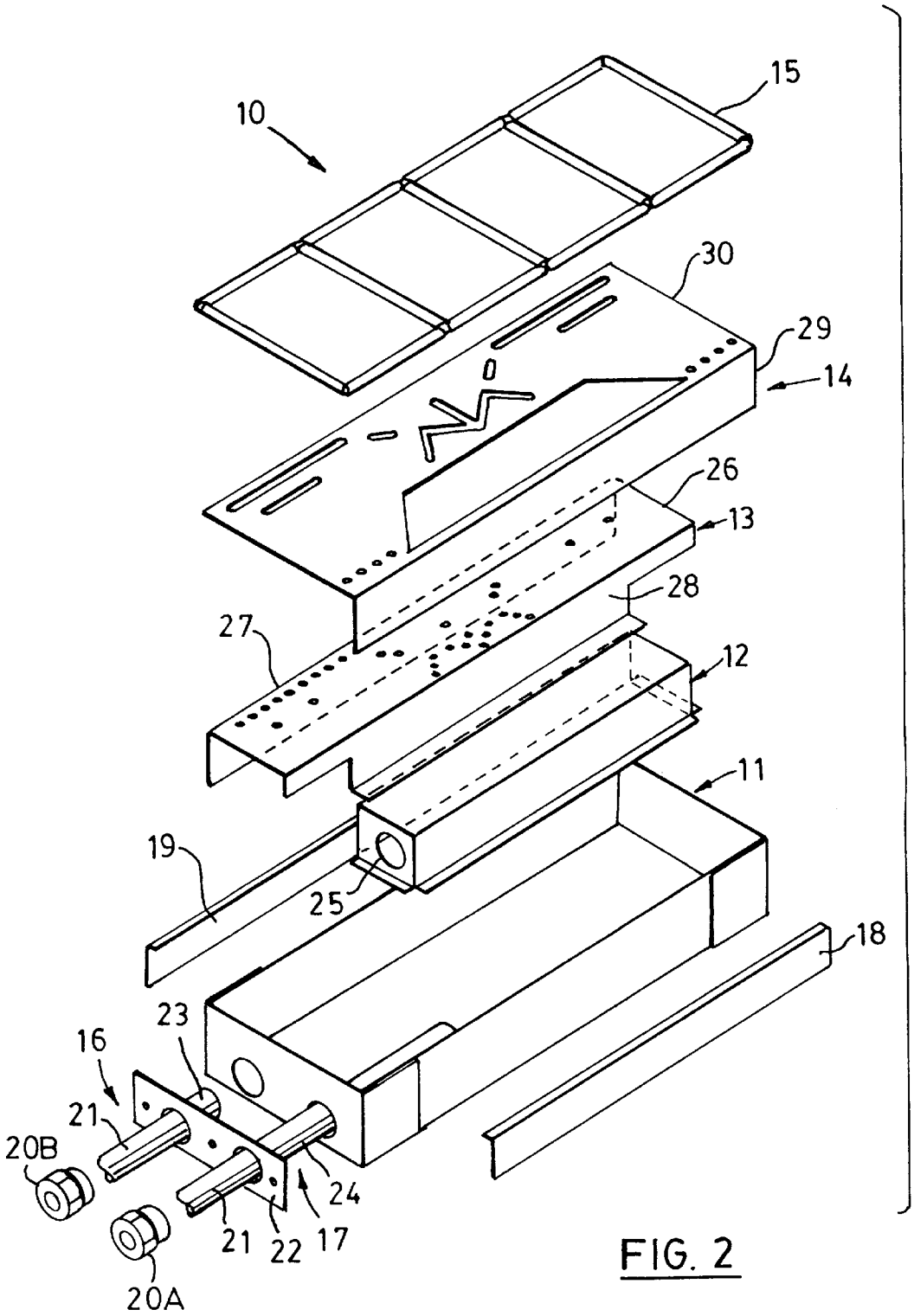
FIG. 2 is a schematic representation of an exploded view of a burner assembly of the present invention.

FIG. 2 shows a gas burner of the present invention in an exploded view. Gas burner 10 has burner housing 11 into which fits burner box 12. Burner box 12 is elongated and fits in the front side of burner housing 11, as viewed in the drawing and which is the front of the gas burner as viewed in use. Burner box 12 extends for a substantial part of the length of the burner housing 11, as illustrated below, but permits gas and air to flow out the top thereof, as also discussed below. Perforated plate 13 fits into burner housing 11 in a side-by-side relationship with burner box 12. Gas distribution plate 14 fits over burner housing 11, and ceramic grid 15 is placed on the top of gas distribution plate 14, to form the exterior surface of burner housing 11. First bracket 18 and second bracket 19 fit on the exterior of burner housing 11 to retain ceramic grid 15 in position. First burner assembly 16 and second burner assembly 17 extend into burner housing 11 in the embodiment shown in FIG. 2, but in the preferred embodiment of FIG. 7 discussed below first elongated tube 16 does not extend into burner housing 11.

In the embodiment illustrated in FIG. 2, first burner assembly 16 has air flow controller 20B on the end thereof which fits on end 21 of tube 23 that forms first burner assembly 16. The preferred air flow controller is an air shutter, which is referred to herein as the primary air shutter. Primary air is the air admixed with the gas in the burner assembly, in contrast with secondary air which is air from exterior to the burner housing and which may be required for complete combustion of gas that has passed through the grid, as described herein. Thus, the air flow controller is particularly in the form of an adjustable air opening, which may be referred to as an adjustable primary air opening, and is preferably in the form of an adjustable primary air shutter. Other adjustable air openings are known.

The present invention will be particularly described herein with respect to the preferred embodiment in which the primary air flow controller is in the form of a primary air shutter. The primary air shutter of first burner assembly 16, and in second burner assembly 17 discussed below, is intended to permit and control the flow of primary air into the elongated tube, and especially the ratio of primary air:combustible gas being fed to the burner. As noted above, an alternate method is described with respect to FIG. 7.

Second burner assembly 17 has primary air shutter 20A on the end thereof which fits on end 21 of tube 24 that forms second burner assembly 17. Primary air shutter 20A and tube end 21 are adapted to control the flow of air through the primary air shutter and into second elongated burner assembly 17, as well as adjusting the flow of air into second burner assembly 17 so as to provide a predetermined ratio of primary air:gas. As discussed herein, the ratio of primary air:combustible gas is different in the two burner assemblies.

Plate 22, which has holes therein for accommodating first and second burner assemblies 16 and 17, fits on the end of burner housing 11 to form a gas-tight seal.

Figure 3:
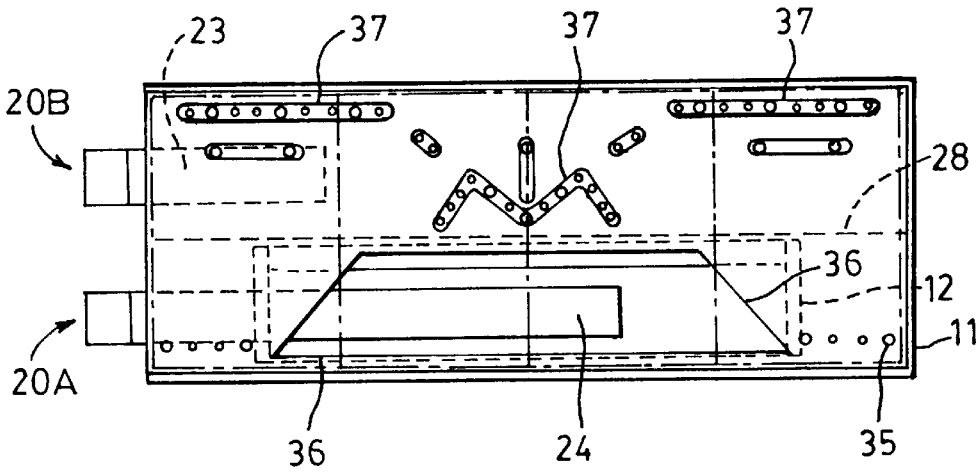
FIG. 3 is a schematic representation of a plan view of the gas burner.
Figure 7:
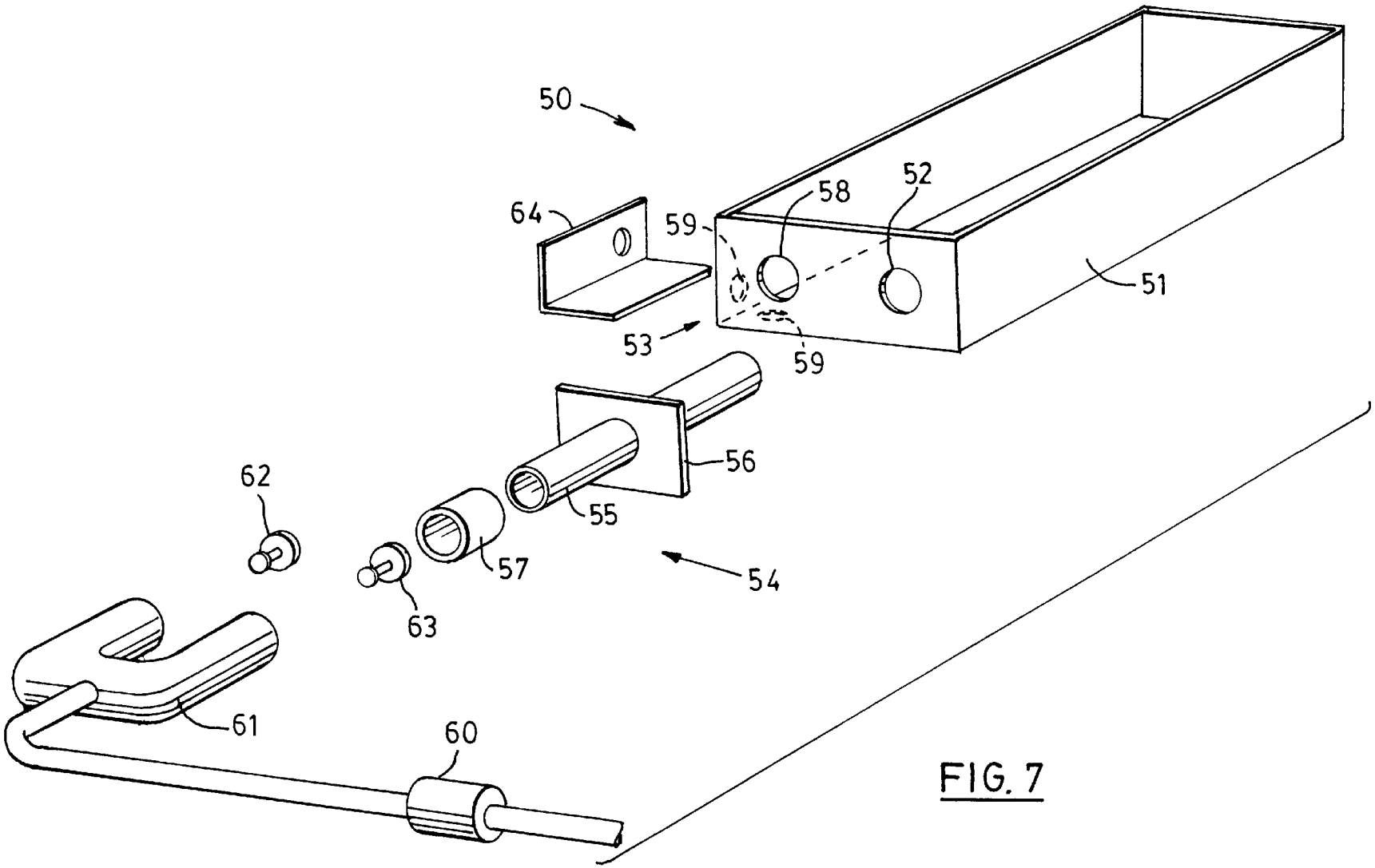
FIG. 7 is a schematic representation of an alternate embodiment of the burner assembly, in exploded view.

Tube 23 of first burner assembly 16 is shown as being shorter than the length of the corresponding tube 24 of second burner assembly 17, as more clearly shown in FIG. 3, and in preferred embodiments does not extend into burner housing 11, as discussed with respect to FIG. 7. Tube 24 extends into burner box 12. Tube 24 passes through hole (opening) 25 located in the end of burner box 12. It is understood that burner box 12 occupies a smaller portion of burner housing 11 than does the region accommodating first burner assembly 16. This has the consequence that the ratio of flow of primary air and gas from first burner assembly to ceramic grid 15 is less than the rate of flow of primary air and gas from second burner assembly 17. As discussed below, the slower rate of flow from first burner assembly 16 facilitates variations in the flame pattern therefrom in the so-called yellow flame.

Burner box 12, with second assembly 17 therein is further separated from the first burner assembly by means of perforated plate 13. Perforated plate 13 has upper panel 26 with a plurality of openings 27 therein, as discussed below, and side panel 28 which extends downward and is in a fitting relationship with burner box 12. Gas can flow around the two ends of the side panel 28 and into the area of burner box 12. This permits gas to flow into and through the perforated holes on gas distribution plate 14 to provide a yellow flame in that area of the plate.

Gas distribution plate 14 has side panel 29 thereon which mates with the corresponding side of burner housing 11. In addition, gas distribution plate 14 has upper panel 30 which has a plurality of openings, orifices and slots therein, as discussed below. It will be noted that primary air and gas flow from the first burner assembly through both perforated plate 13 and gas distribution plate 14, whereas primary air and gas from second burner assembly 17 must only pass through gas distribution plate 14. In various embodiments of the invention, gas distribution plate 14 may be of symmetrical construction or not of symmetrical construction. Ceramic grid 15 has a honeycomb-type distribution of openings therein, not shown, through which mixtures of combustible gas and primary air will flow, and be ignited on the upper surface or otherwise above ceramic grid 15.

FIG. 3 shows a plan view of the gas burner of the present invention. The gas burner has burner housing 11 into which extend first burner assembly 16 and second burner assembly 17, respectively. Exterior to housing 11 are primary air shutters (air openings) 20A and 20B, as discussed above. In the embodiment of FIG. 3, tube 23 of first burner assembly 16 extends a short distance into burner housing 11, but in other preferred embodiments, assembly 16 does not extend into burner housing 11. Tube 24 of second burner assembly 17 extends for a substantial length of burner housing 11, but it does not extend to the end of burner box 12. The view of FIG. 3 shows openings 35 and 36 of gas distribution plate 14, which are above second burner assembly 17. While such openings might be referred to as orifices, the latter term is typically used with respect to control of flow of gas. In addition the view shows the plurality of slots 37 of gas distribution plate 14 that are above first burner assembly 16.

Figure 4:
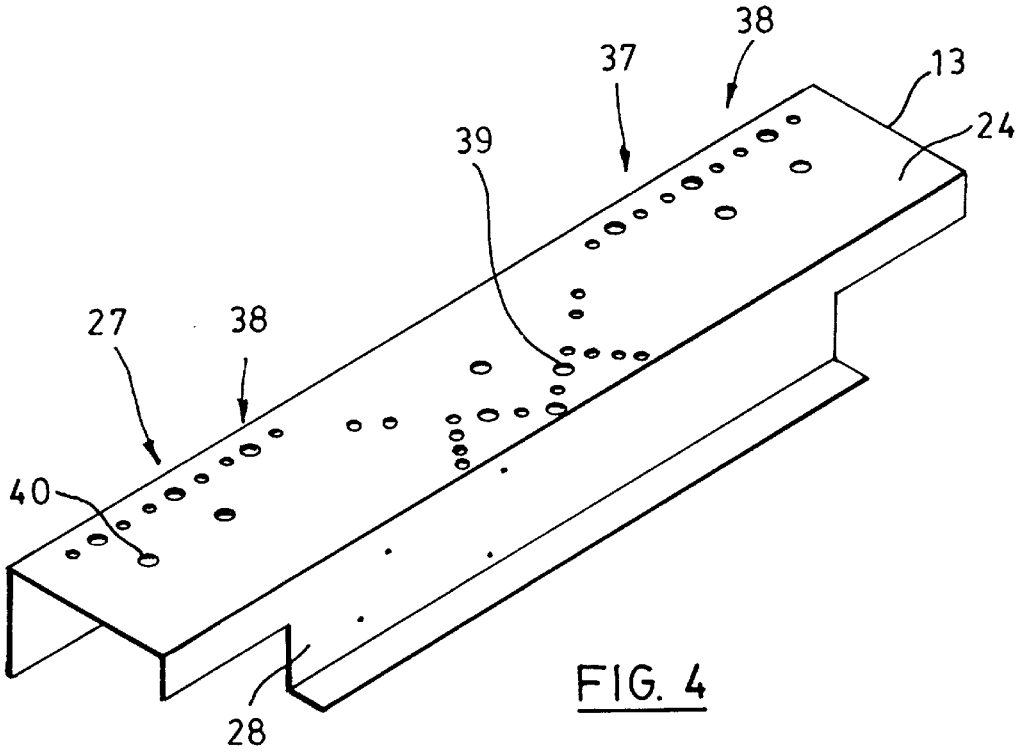
FIG. 4 is a schematic representation of the burner box perforated plate.

FIG. 4 shows perforated plate 13. Perforated plate 13 has upper panel 26 with openings 27 therein, and side panel 28 that extends downwardly, and which would be in a side-by-side relationship with burner box 12. Upper panel 26 has an array of openings which may or may not be in a linear configuration, indicated by 38, on opposed ends of the front edge of upper panel 26. As illustrated the array of openings are a pattern of openings of varying sizes. Upper panel 26 additionally has a centrally located set of openings that are in a pattern that resembles the shape of the letter W. It is to be understood, however, that the shape of a letter W is only one example of the pattern that may be used, and that other patterns of openings may be used, particularly depending on the arrangement of logs and the distribution of flames to be achieved. It is further understood that the pattern of openings on perforated plate 13 and on upper panel 30, discussed below, would align with the various openings in gas distribution plate 14. Intermediate between the array of openings 38 and the set of openings 39 are a series of scattered openings generally indicated by 40.

It is to be understood that the pattern of openings may be varied particularly depending on the visual effects required of the fire, and the arrangement of logs that are placed on top of ceramic grid 15. However, it is generally preferred to have a series of openings that would be along the front edge of the burner assembly, as viewed by a person watching the fire, and a set of openings that are more centrally located, and which would normally be located under a central arrangement of ceramic logs on ceramic grid 15.

Figure 5:
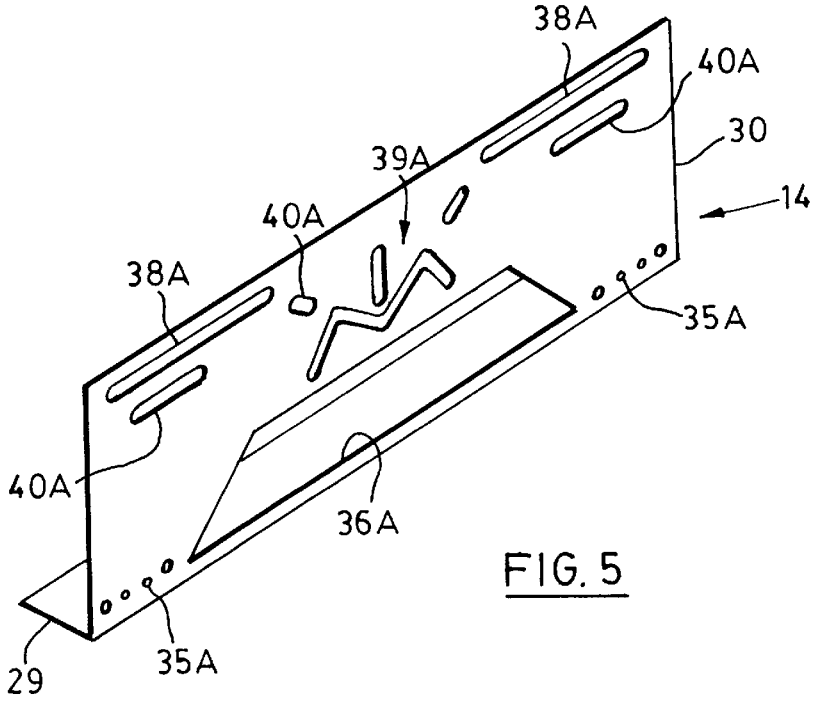
FIG. 5 is a schematic representation of the gas distribution plate, on its edge.

FIG. 5 shows gas distribution plate 14, in an edge view with upper panel 30 being shown in a vertical orientation. Gas distribution plate 14 has a plurality of slots that generally correspond in shape and location to the openings in perforated plate 13 which is located immediately underneath gas distribution plate 14. Thus, gas distribution plate 14 has slots on the front edge thereof, indicated by 38A, which may be linear slots, a series of slots generally in the shape of the letter W (in the embodiment illustrated) in a central location, indicated by 39A, and additional slots in an intermediate area, indicated by 40A. In addition, gas distribution plate 14 has a large centrally located opening, 36A, which as illustrated is a truncated triangle, but other shapes may be used, with a row of openings on each end thereof indicated by 35A. It is to be understood that the openings indicated by 35A, 38A, 39A and 40A are located generally above first burner assembly 16, and that opening 36A is located generally above second burner assembly 17.

Figure 6:
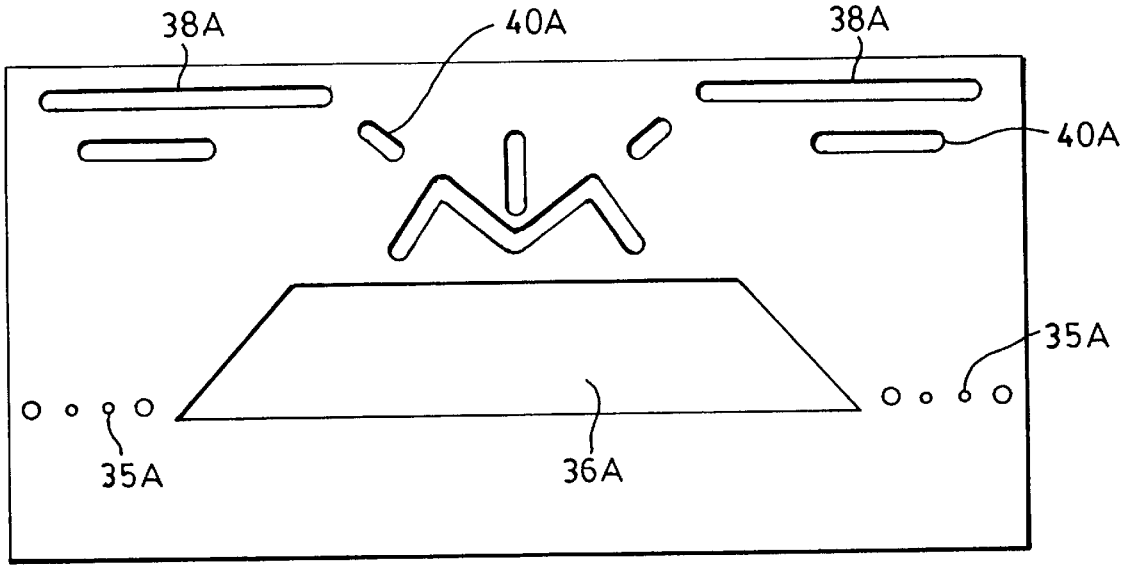
FIG. 6 is a schematic representation of a plan view of the gas distribution plate.

FIG. 6 shows gas distribution plate 14 in plan view, with the openings and slot as discussed above. It will be noted that the openings 35A closely related to opening 36A are shown as being of two different sizes. As discussed above, the openings and slots shown in FIG. 6 may be varied in shape size and location.

When the gas burner is assembled, it is understood that the various components are attached in a gas tight manner in accordance with acceptable manufacturing processes for gas burners. The primary air shutters, 20A and 20B, would normally be set at the time of manufacture in accordance with predetermined specifications, but could be adjustable.

Second burner assembly 17 may be referred to as a burner, as this burner is intended to provide the red glow to the ceramic logs and ceramic grid 15 in region of the fire that would be the front as viewed. Primary air shutter 20A is set to provide a mixture of combustible gas and primary air fed to the burner that has a high ratio of primary air:combustible gas, so that when the gas ignites on the surface of the ceramic grid, the flame is short and blue. The flame is short in height which in turn heats the ceramic burner material to a temperature at which it glows a bright red. The pattern in which the ceramic grid glows is the same as the large geometric pattern 36A on the gas distribution plate 14. High temperature materials are generally used to manufacture logs that are placed on and around the radiant portion of this grid in order to simulate an ember bed effect of a wood fire, with ceramic materials being preferred. The gas and primary air mixture flows through gas distribution plate 14 before passing through the honeycomb-type structure of ceramic grid 15.

Combustible gas and primary air are mixed in the same way as for the burner assembly 17, but a lower ratio of primary air to combustible gas is used. This may also be accomplished using the preferred embodiment of FIG. 7, which uses a different method of mixing primary air and gas as is described for burner assembly 17. The mixture of primary air and gas travels through the holes of the rear perforated channels, and through the slots in the gas distribution plate, and then through the corresponding holes of the honeycomb-type structure of the ceramic grid. As a result of the lower ratio of primary air to combustible gas, the flames that are obtained are much taller and normally require secondary air from within the combustion chamber in order to complete combustion of the gas. This causes the flames to burn with more yellow colour and thus to more closely simulate that of a wood fire. In addition, the size of the burner housing 11 is such that the pressure in the burner housing 11 continuously changes by small amounts due to movement of the premixed primary air and gas within the burner housing 11. This causes fluctuations in the flow of the mixture of gas and primary air through the distribution holes in the gas distribution plate and causes the flame to flicker and dance in the manner of a natural wood fire.

In preferred embodiments of the present invention, the gas burner has a first burner assembly that provides less primary air for combustion of the gas at the orifices, than the second burner assembly. Preferably, the first burner assembly provides a yellow flame and the second burner assembly provides a blue flame.

FIG. 7 shows an alternate, and preferred, embodiment of the burner assembly, in exploded view. Burner housing 51 has two inlets 52 and 53. Inlet 52 accommodates the second elongated burner assembly, generally indicated by 54, which has elongated tube 55 that passes through plate 56 that fits on the end of burner housing 51 to form a gas tight seal thereon. Elongated tube 55 is also connected to primary air shutter 57, which as discussed herein has an adjustable air opening therein for control of the ratio of primary air to combustible gas.

Inlet 53 accommodates the first burner assembly. Inlet 53 is in the form of a opening 58 with a plurality of openings 59 in the back side and bottom of burner housing 51 in close proximity to opening 58. Opening 58 is for inlet of combustible gas into burner housing 51, whereas openings 59 are for inlet of primary air. The inlet of primary air is controlled by a shutter plate 64 located outside burner housing 51 at openings 59.

The inlet of gas to the burner assemblies is controlled by gas valve 60 which is connected to gas manifold 61. Gas passes from gas manifold 61 through gas orifices 62 and 63 into the respective burner assemblies.

The ratio of primary air to combustible gas is controlled by primary air shutter 57 and a shutter plate 64 located outside burner housing 51. Shutter plate 64 is intended to slide on burner housing 51, so that the opening therein adjustably covers openings 59 in burner housing 51.

Figure 8:
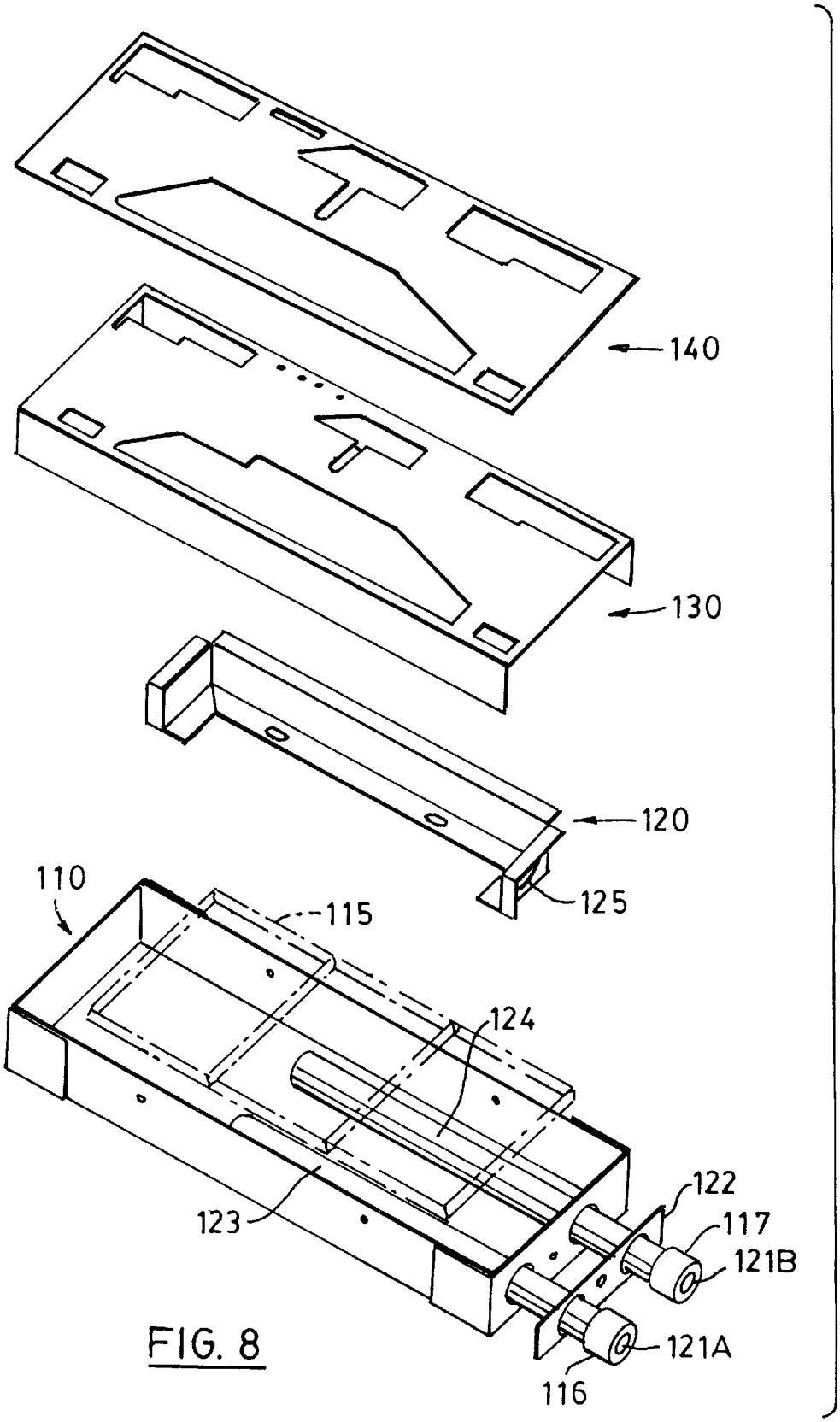
FIG. 8 is a schematic representation of a further embodiment of the present invention.

In the embodiment illustrated in FIG. 8, first burner assembly 116 has air flow controller 121A on the end thereof which fits onto tube 123, to form first burner assembly 116. Similarly, second burner assembly 117 has air flow controller 121B on the end thereof which fits onto tube 124, to form second burner assembly 117.

Burner box 120 is located within burner housing 110. Both first burner assembly 116 and second burner assembly 117 extend into burner housing 110, but first burner assembly 116 extends into burner box 120 through opening 125 thereof. Thus, while both burner assemblies are within burner housing 110, only first burner assembly 116 is within burner box 120.

Perforated plate 130 fits over burner housing 110. It will be noted that perforated plate 130 has a different pattern of openings than the corresponding plate illustrated in FIG. 2, thereby showing an alternative embodiment of the openings that may be embodied in the perforated plate. Gas distribution plate 140 fits on perforated plate 130, and has a similar pattern of openings. Ceramic grid 115 is placed on top of gas distribution plate 140.

It is understood that the gas burner of the embodiment of FIG. 8 will have appropriate brackets to retain the various components of the burner in place.

Adjustment, control and use of the embodiment shown in FIG. 8 is similarly to that described previously with respect to FIG. 2.

The present invention provides a fireplace in which there is provided a flame to causes the ceramic grid and/or ceramic logs to glow like embers in a wood fire, and provide a yellow flame that varies with time e.g. the yellow flame continuously exhibits rises and falls, and sideways movement, thereby simulating the fire from a wood fire.

We claim:

1. A gas burner for a fireplace, comprising:

an elongated burner housing having a length and a width, said elongated burner housing having a grid of openings in a surface thereof and a gas distribution plate located underneath and adjacent said grid, said grid being formed from heat resistant material, said elongated burner housing having a burner box and a chamber arranged therein in a side-by-side relationship along a length of the housing, said chamber having a perforated plate forming an upper surface thereof, each of the first and second burner assemblies having a gas mixing area with an inlet for air and combustible gas and air flow controllers for controlling the ratio of said air to said gas in the first burner assembly lower than the ratio in the second burner assembly, said first burner assembly communicating with said chamber and said second burner assembly communicating with said burner box such that (I) air and gas is adapted to pass from said second burner assembly into the burner box and through said gas distribution plate and (II) air and gas is adapted to pass from said first burner assembly through said chamber and through both said perforated plate and said gas distribution plate.

2. The gas burner of claim 1 in which each said air flow controller is in the form of an adjustable opening for inlet of primary air.

3. The gas burner of claim 2 in which each said air flow controller is in the form of an adjustable primary air shutter.

4. The gas burner of claim 2 in which the second burner assembly is adapted to provide a greater amount of primary air for combustion of said gases at said orifices than said first burner assembly.

5. The burner of claim 1 in which the first burner assembly is adpated to provide a yellow flame and the second burner assembly is adapted to provide a blue flame.

6. The burner of claim 1 in which the ratio of primary air to gas for the first burner assembly is such that secondary air from exterior to said burner assembly is required for complete combustion of gas.

7. The burner of claim 1 in which the grid is formed of ceramic.

8. The burner of claim 1 in which the grid is formed from a heat resistant material other than ceramic.

9. The gas burner of claim 1 in which the burner box extends for a part of the length of the burner housing.

10. The gas burner of claim 9 in which the burner box extends for a substantial part of the length of the burner housing.

11. The burner of claim 1 in which the second burner assembly extends further into the burner housing than the first burner assembly.

* * * * *